US005305939A

United States Patent [19]

Deschenes et al.

[11] Patent Number: 5,305,939

[45] Date of Patent: Apr. 26, 1994

[54] NEEDLE FOR USE AS PART OF A PLASTIC FASTENER DISPENSING TOOL

[75] Inventors: Charles L. Deschenes, North Attleboro, Mass.; William J. Cooper, Woonsocket, R.I.; Paul A. Davignon, Uxbridge; F. Thomas Bilek, Milford, both of Mass.

[73] Assignee: Avery Dennison Corporation, Pasadena, Calif.

[21] Appl. No.: 950,420

[22] Filed: Sep. 23, 1992

[51] Int. Cl.[5] ..... B65C 7/00; A41H 37/00

[52] U.S. Cl. ..... 227/67

[58] Field of Search ..... 227/67, 71, 156

[56] References Cited

U.S. PATENT DOCUMENTS

| | | |
|---|---|---|
| 3,103,666 | 9/1963 | Bone . |
| 3,815,798 | 6/1974 | Lavitch et al. . |
| 3,850,360 | 11/1974 | Ritchey . |
| 3,893,612 | 7/1975 | Bone . |
| 3,895,753 | 7/1975 | Bone . |
| 3,990,619 | 11/1976 | Russell . |
| 4,040,555 | 8/1977 | Jenkins . |
| 4,121,487 | 10/1978 | Bone . |
| 4,273,279 | 6/1981 | Kunreuther . |
| 4,456,161 | 6/1984 | Russell . |
| 4,533,076 | 8/1985 | Bourque . |
| 4,611,740 | 9/1986 | Kunreuther . |
| 4,995,475 | 9/1990 | McCarthy et al. . |
| 4,998,661 | 3/1991 | Deschenes et al. . |
| 5,024,365 | 6/1991 | Bourque . |

*Primary Examiner*—Scott Smith

*Attorney, Agent, or Firm*—Kriegsman & Kriegsman

[57] ABSTRACT

A needle for use as part of a fastener dispensing tool adapted for dispensing plastic fasteners of the type typically used to attach tags to products for marking and identification. In one embodiment, the needle is made from a single sheet of metal by a stamping and/or rolling technique, and comprises an elongated, generally cylindrical, hollow, slotted member having a stem portion and a base portion. The stem portion terminates at its front end in a relatively sharp tip. The base portion, which is sized and shaped for insertion in an opening in the nose of the tool, includes a pair of outwardly extending, spring biased tabs. A first portion of one of the tabs is sized and shaped to releasably engage a recessed area formed in one of the walls of the opening so as to prevent unintended removal of the base portion from the opening and to limit rearward insertion of the base portion into the opening. This first portion also extends partially out of the opening so as to permit a user to grasp it and to push it inwardly out of engagement with the recessed area. A second portion of the same tab is sized and shaped to engage another wall of the opening so as to prevent upward movement of the base portion in the opening. The other tab serves as a registration member to align the base portion in its desired longitudinally, vertical and axial orientations.

14 Claims, 8 Drawing Sheets

NEEDLE FOR USE AS PART OF A PLASTIC FASTENER DISPENSING TOOL

BACKGROUND OF THE INVENTION

The present invention relates generally to tools for use in dispensing plastic fasteners and wore particularly to needles which are used in such tools.

Plastic fasteners are widely used in commerce to attach tags or other items to articles in a manner which minimizes the risk of inadvertent detachment therefrom. One type of plastic fastener is manufactured in the form of fastener stock comprising a pair of continuously connected, elongated side members which are interconnected by a plurality of thin transverse cross links. Typically, one side member comprises a plurality of end-bars or T-bars joined together by severable connectors. The fastener stock is usually produced by molding or stamping from flexible plastic materials, such as nylon, polyethylene, and polypropylene. Additional information pertaining to fastener stock may be obtained from the following commonly assigned U.S. patents, all of which are incorporated herein by reference: U.S. Pat. No. 4,955,475, issued Sep. 11, 1990; U.S. Pat. No. 4,456,161, issued Jun. 26, 1984; U.S. Pat. No. 4,121,487, issued Oct. 24, 1978; and U.S. Pat. No. 3,103,666, issued Sep. 17, 1963.

The above-described fastener stock is typically loaded into a dispensing tool, often referred to as a "tagger gun." A tagger gun normally includes a hollow needle having a longitudinal slot extending over its length. The fastener stock is inserted into the tagger gun behind the needle. Upon actuation of a trigger mechanism in the gun, an individual fastener i-s separated from the fastener stock and is inserted into the desired article of commerce through the needle.

In U.S. Pat. No. 4,273,279, which is incorporated herein by reference, a typical needle having a single part construction is described. The needle includes a shank or "stem" portion which has a relatively sharp tip to permit penetration into the article to be attached and an integrally formed substantially cylindrical base portion. The shank portion is hollow to permit the T-bar end of the fastener to pass therethrough and has a longitudinal slot to permit the filament of the fastener to extend therefrom as the T-bar end moves through the needle. The base portion includes a central bore with an inner diameter equal to the inner diameter of the hollow shank. The base portion also has a longitudinal slot aligned with the slot in the shank. The needle is made by machining the shank portion and the base portion from a single piece of metal. As can readily be appreciated, however, machining metal into a desired shape can be a rather arduous and time consuming task which allows little margin for error.

Also disclosed in U.S. Pat. No. 4,273,279 is a needle assembly having a conventional two part structure. The needle assembly includes a shank portion stamped from a piece of a steel and a base portion which is formed of plastic and is molded around the shank portion. One disadvantage with this type of needle, however, is that the molding process is rather expensive, accounting for an overwhelming percentage of the total cost of manufacturing the needles.

Because needles used in tagger guns tend to break frequently and require replacement, they are typically removably mounted in an opening formed in the front end or "nose" of the tagger gun and are releasably secured therein by means of a locking mechanism in the tagger gun.

For example, as shown in FIGS. 21 and 22 of U.S. Pat. No. 4,456,161, the needle locking mechanism includes a locking pin, which engages a corresponding recessed area formed in the needle. The locking pin is also provided with a cut-out slot which provides a passageway for insertion and removal of the needle. The locking pin is biased in its locking position by means of a spring mounted in the tagger gun. When the locking pin is pushed towards the spring to compress it, the slot on the locking pin aligns with the needle to free it for removal. Preferably, that portion of the locking pin engaging the recessed area of the needle in locking position is rectangular or square in cross-section.

Unfortunately, the above-described needle locking mechanism suffers from certain disadvantages. For example, the needle may be inserted into the opening in the tagger gun in any one of an infinite number of angular orientations. An inherent problem with this mounting procedure is that it is not intuitively obvious or readily apparent as to what angular orientation is correct. If the angular orientation of the needle is incorrect, the locking pin will not properly engage the recessed area in the needle, frequently resulting in needle breakage or in the jamming of the needle in the tagger gun, or in an ineffective locking of the needle. Moreover, one or more components of the locking mechanism may break or require replacement after repeated or prolonged use.

Another patent of interest to the present invention is the commonly assigned U.S. Pat. No. 4,998,661, issued Mar. 12, 1991 and incorporated herein by reference. In this patent, a needle assembly adapted for removable mounting on the front end of a tagger gun is disclosed. The needle assembly comprises a needle encased in a holder which may be easily secured to and removed from the front end of the tool, the holder defining in conjunction with the remainder of the tool at least a major portion of the feed track. In a preferred construction of the needle assembly, the needle is a hollow slotted metal structure and the holder 4 is comprised of plastic which is injection molded around the needle.

In U.S. Pat. No. 4,877,172 there is described and illustrated in FIG. 4 the use of a tapered, needle locking screw for locking an inserted needle in place. Although the needle locking screw provides a secure, snug engagement of an inserted needle, it still requires precise alignment of the needle before locking.

SUMMARY OF THE INVENTION

It is an object of the present invention to provide a new and improved needle for use as part of a tool for dispensing plastic fasteners.

It is another object of the present invention to provide a needle as described above which can be removably mounted in an opening in the nose in a fastener dispensing tool and releasably secured in place.

It is yet another object of the present invention to provide a needle as described above which does not require an extraneous needle locking mechanism for releasably securing the needle in an opening in the nose of the fastener dispensing tool and, therefore, can be more easily inserted into and removed from the opening in the nose of the fastener dispensing tool.

It is still another object of the present invention to provide a needle as described above which can be made by a more economical manufacturing process than is typically available for existing needles.

In accordance with the objects of the present invention as broadly recited above, a needle for use as part of a fastener dispensing tool comprises an elongated member having a stem portion and a base portion, the stem portion being generally cylindrically shaped and terminating i-n a sharp tip at its front end, "he base portion being sized and shaped for insertion into an opening formed in the nose of the fastener dispensing tool, the base portion having a spring tab for releasably securing the base portion within the opening of the fastener dispensing tool and a generally cylindrically shaped bottom section, the needle having a longitudinal slot extending through said stem portion and said bottom section oil said base portion.

Preferably, the base portion and the stem portion of the needle are made from a single sheet of metal by a stamping and/or rolling technique. Preferably, the base portion of the needle is shaped to define a pair of outwardly projecting spring tabs which are adapted to press against the walls of the opening formed in the nose of the tool. A first portion of one of the tabs is sized and shaped to releasably engage a recessed area formed in one of the walls of the opening so as both to prevent unintended removal of the base portion from the opening and to limit rearward insertion of the base portion into the opening. This first portion also extends partially out of the opening so as to permit a user to grasp it and to push it inwardly out of engagement with the recessed area. A second portion of the same tab is sized and shaped to engage another wall of the opening so as to prevent vertical movement of the base portion in the opening. The other tab serves as a registration member to align the base portion in its desired longitudinal, vertical and axial orientations.

Additional objects, as well as features and advantages, of the present invention will be set forth in part in the description which follows, and in part will be obvious from the description or may be learned by practice of the invention. In the description, reference is made to the accompanying drawings which forms a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate preferred embodiments of the invention and, together with the description, serve to explain the principles of the invention. In these drawings wherein like reference numerals represent like parts.

DETAILED DESCRIPTION OF PREFERRED EMBODIMENTS

Figure 1:
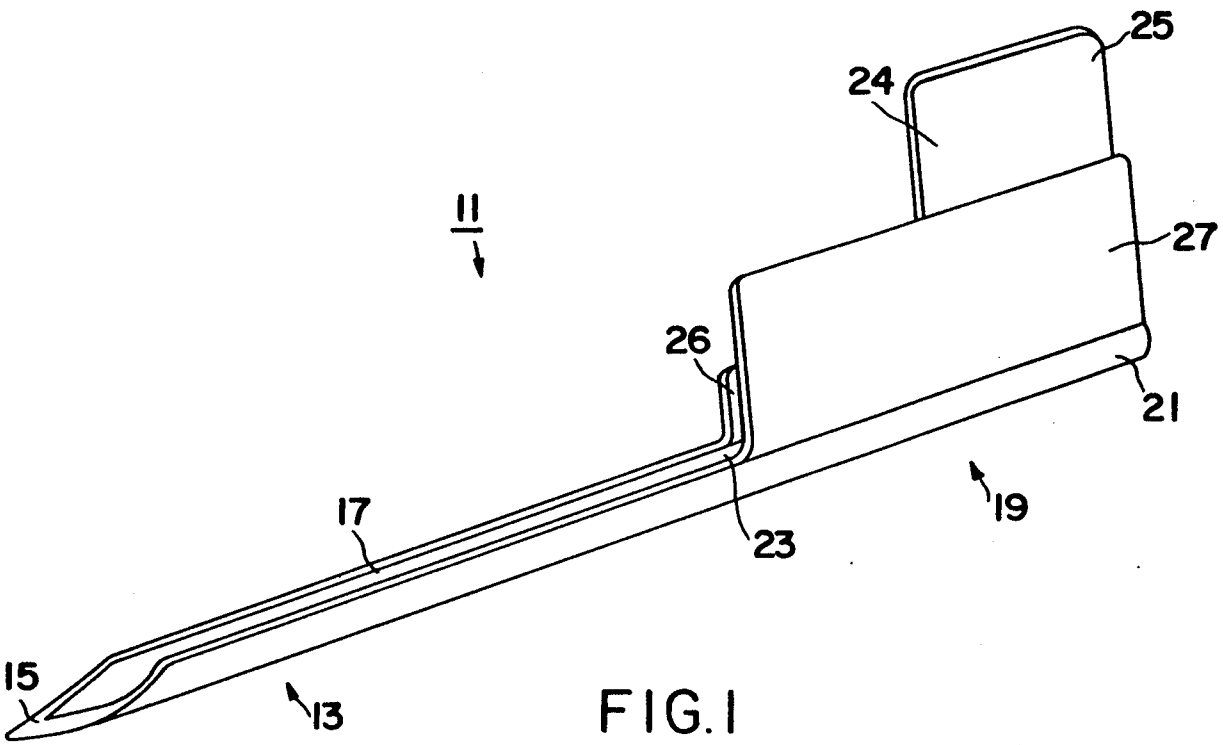
FIG. 1 is a perspective view of one embodiment of a needle adapted for use as part of a tool for dispensing plastic fasteners, the needle being constructed according to the teachings of the present invention.
Figure 2:
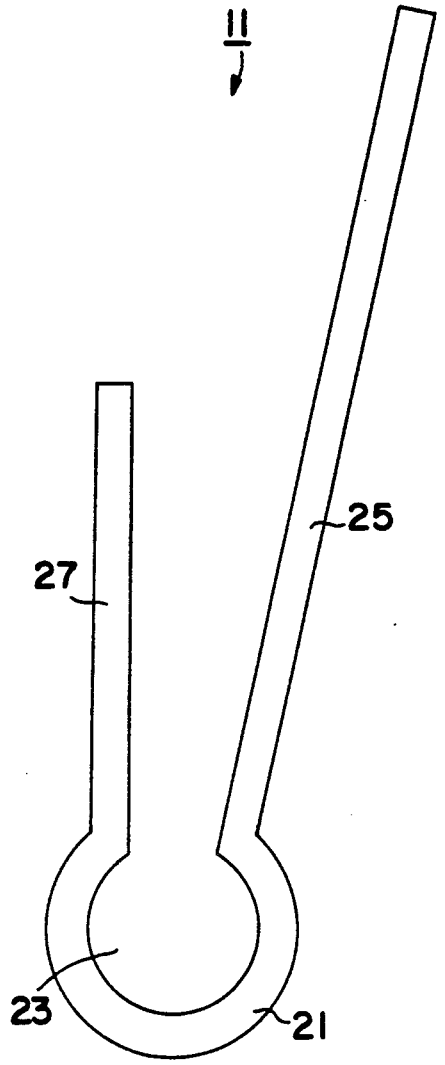
FIG. 2 is a rear view of the needle shown in FIG. 1.
Figure 3:
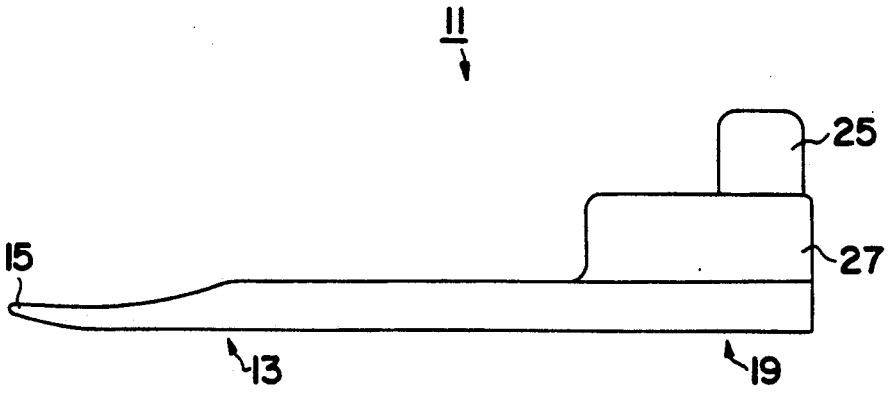
FIG. 3 is a side view of the needle shown in FIG. 1.
Figure 4:
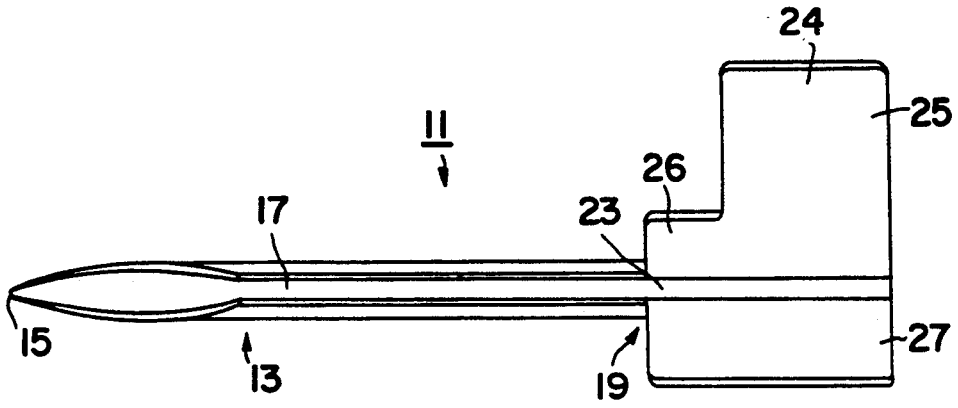
FIG. 4 is a top view of the needle shown in FIG. 1.

Referring now to the drawings and more particularly to FIGS. 1 through 4, there is shown one embodiment of a needle for use as part of a tool for dispensing plastic fasteners, the needle being constructed according to the teachings of the present invention and represented generally by reference numeral 11.

Needle 11, which is preferably made by stamping and/or rolling a single sheet of metal, comprises an elongated, hollow, cylindrically shaped stem portion 13. Stem portion 13 terminates at its forward end with a relatively sharp tip 15 and is provided with a longitudinally extending slot 17. The inner diameter of stem portion 13 is somewhat larger than the outer diameter of the T bar end of a plastic fastener (not shown) to be dispensed through needle 11. The width of slot 17 is sufficiently large to accommodate the cross link portion of the fastener to be dispensed through the needle.

Needle 11 also includes a base portion 19. Base portion 19 includes a cylindrically shaped bottom section 21 which has an inner diameter substantially equal to the inner diameter of stem portion 10, and is aligned therewith. A longitudinally extending slot 100, is formed in bottom section 21 and is aligned with slot 17 of stem portion 13 so as to permit the cross link of the fastener being dispensed by the tool to extend from the T bar end as the latter is pushed through the needle. Base portion 19 also includes a pair of spring tabs 24 and 27 which extend generally upwardly and outwardly on opposite sides of slot 23.

As will hereinafter be discussed in greater detail, base portion 19 of needle 11 is sized and shaped for insertion into an opening 31 formed at the front end 33 of a tagger gun, see FIGS. 5 and 6. When being assembled, base portion 19 of needle 11 is inserted Into opening 31 from front 34 of font end 33. When base portion 19 is inserted into opening 31 spring, tabs 24 and 27 press against the inner walls 37 and 39 respectively, of opening 31. Tab 14 includes a first portion 25 and a second portion 26.

First portion 25 is shaped to fit into a recessed area of opening 31 in such a way as to prevent the unintended removal of base portion 19 from opening 31. In addition, when mounted in place the top of first portion 25 of tab 24 extends up above opening 31 in such a way as to permit a user +lo grasp it and to push it inwardly out of engagement with the recessed area so that base portion 19 may be removed from opening 31. Second portion 26 of tab 24 is shaped and located relative to first portion 25 so as to abut another portion of opening 101 in such a way as to minimize vertical movement of base portion 19 within opening 31. Tab 27 serves as a registration member to help keep the needle in its desired longitudinal, vertical and axial (i.e. angular) orientation when mounted on the tagger gun.

Preferably, needle 11 is made of a metal of the type typically used in tagger gun needles. Examples of suitable metals for needle 11 are a beryllium/copper alloy, stainless steel, and plated or coated steel. As can readily be appreciated, one advantage to the construction of the needle of the present invention is that the needle can be manufactured in its entirety by a stamping and/or roll forming process. Such a process is considerably less expensive and time intensive than the machining process or the combination stamping/molding process described above in connection with the manufacture of conventional needles.

Figure 5:
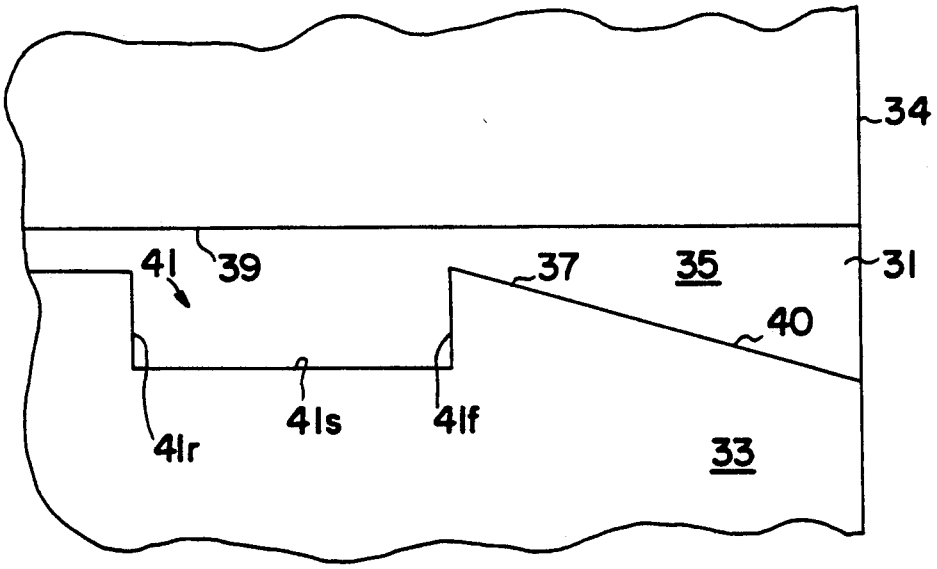
FIG. 5 is a top, fragmentary view of the front end of a fastener dispensing tool illustrating the opening in which the needle of FIG. 1 may be removably mounted.
Figure 6:
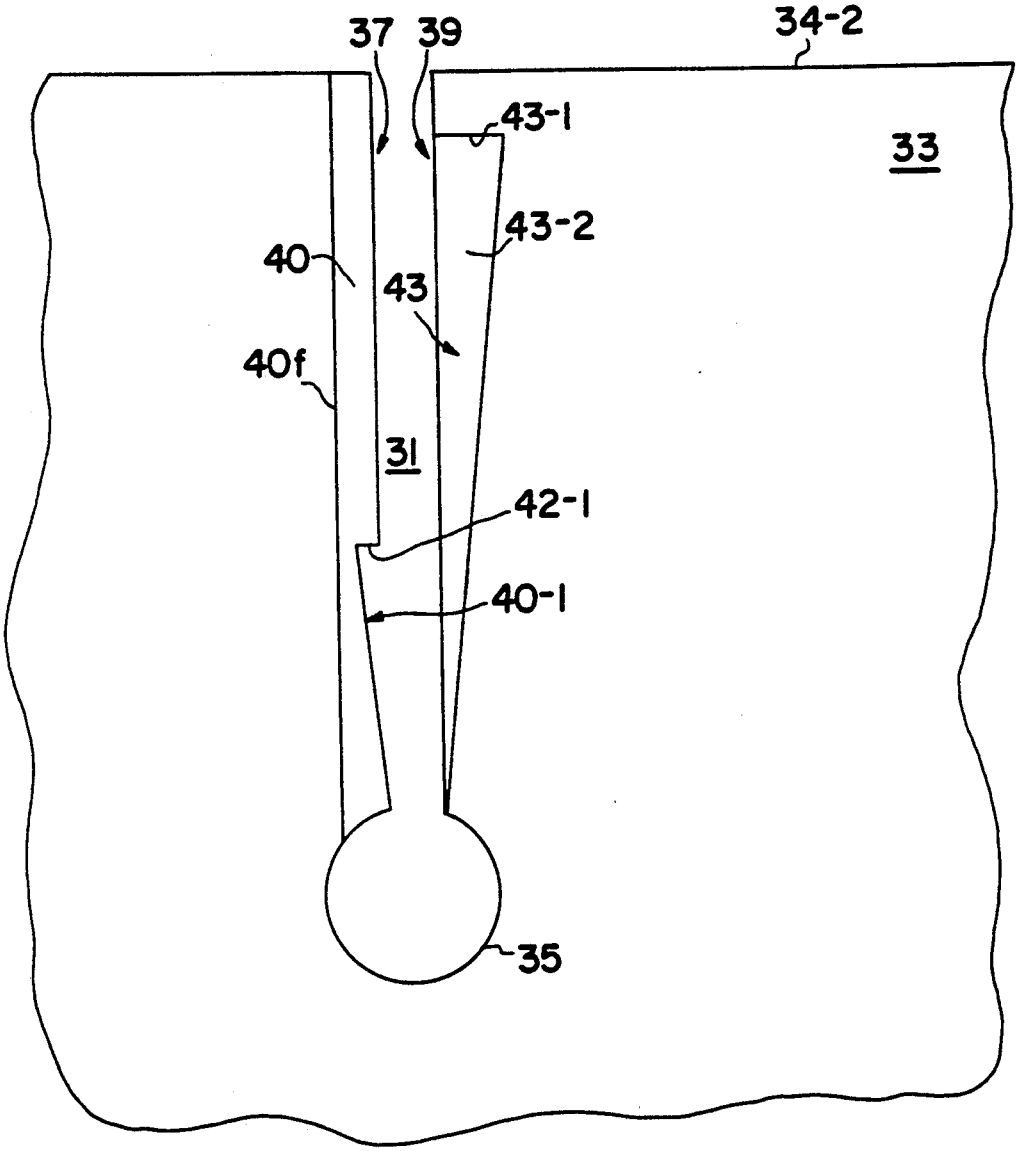
FIG. 6 is a front, fragmentary view of the front end of the fastener dispensing tool shown in FIG. 5.

As can be seen in FIGS. 5 and 6, opening 31 in front end 33 is of a general slot type configuration extending in from front 34 of nose 33 and down from the top 34 2 of nose 33. Opening 31 is defined by a curved bottom wall 35 and a pair of upwardly extending side walls 37 and 39. Bottom wall 35 is shaped to receive bottom section 21 of base 19 and side walls 37 and 39 are shaped to receive tabs 24 and 27, respectively.

Side wall 37 includes an inwardly tapering front portion 40 and a rearwardly disposed, generally rectangularly shaped, recessed area 41. Front portion 40 includes a notch 42, which is sized and shaped to receive second portion 26 of tab 104. Notch 42 is defined in part by a top surface 42 1, which serves to limit vertical movement of second portion 26 of tab 24 when base portion 19 is inserted into opening 31 (see FIG. 8). Area 41 is defined by a rear surface 41*r*, a side surface 41*s*, and a front surface 41*f*. Area 41 is appropriately dimensioned so that when first portion 25 of tab 24 is inserted thereinto (i.e., when base portion 19 is fully inserted into opening 31), longitudinal movement of base portion 19 within opening 31 is prevented, Side wall 39 includes a notch 43, which is sized and shaped to recieve tab 27. Notch 43 is defined in part by a top surface 43 1, which serves to limit upward movement of tab 27, and a rear surface 43 2, which serves to limit insertion of base portion 19 into opening 31.

Walls 37 and 39 also limit rotational movement of base portion 19 by engaging tabs 24 and 27.

The front end of opening 31 (which spans from the front surface 40*f* of portion 40 across notch 43) is approximately the same width as the rear end of needle 11 in its relaxed position. Consequently, a user may mount needle 11 in opening 31 simply by aligning the rear end of needle 11 with the front end of opening 31 and then sliding needle 11 into opening 31 until first portion 25 of spring tab 24 locks into place in area 41. There is no need to push tab 24 inwardly before pushing base portion 19 through opening 31. Thus, installation of needle 11 in tool 31 can be achieved in one motion and, assuming that nose 33 is kept stationary, can be accomplished using only one hand.

Figure 7:
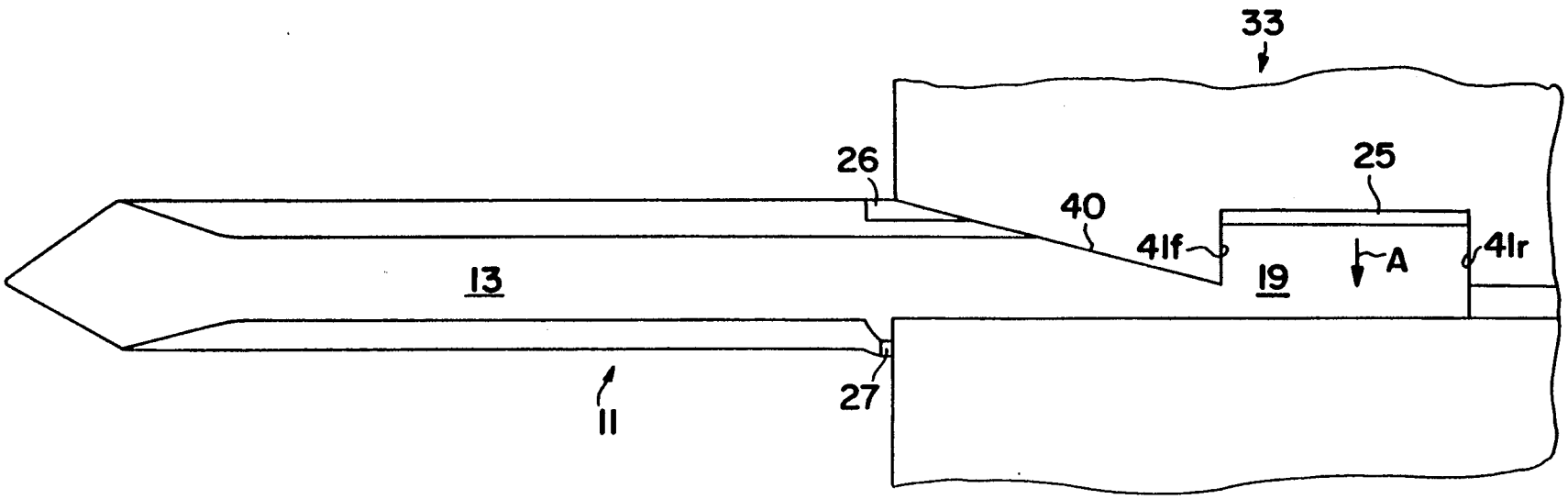
FIG. 7 is a top, fragmentary view showing the needle of FIG. 1 mounted in the opening in the tool of FIG. 5.
Figure 8:
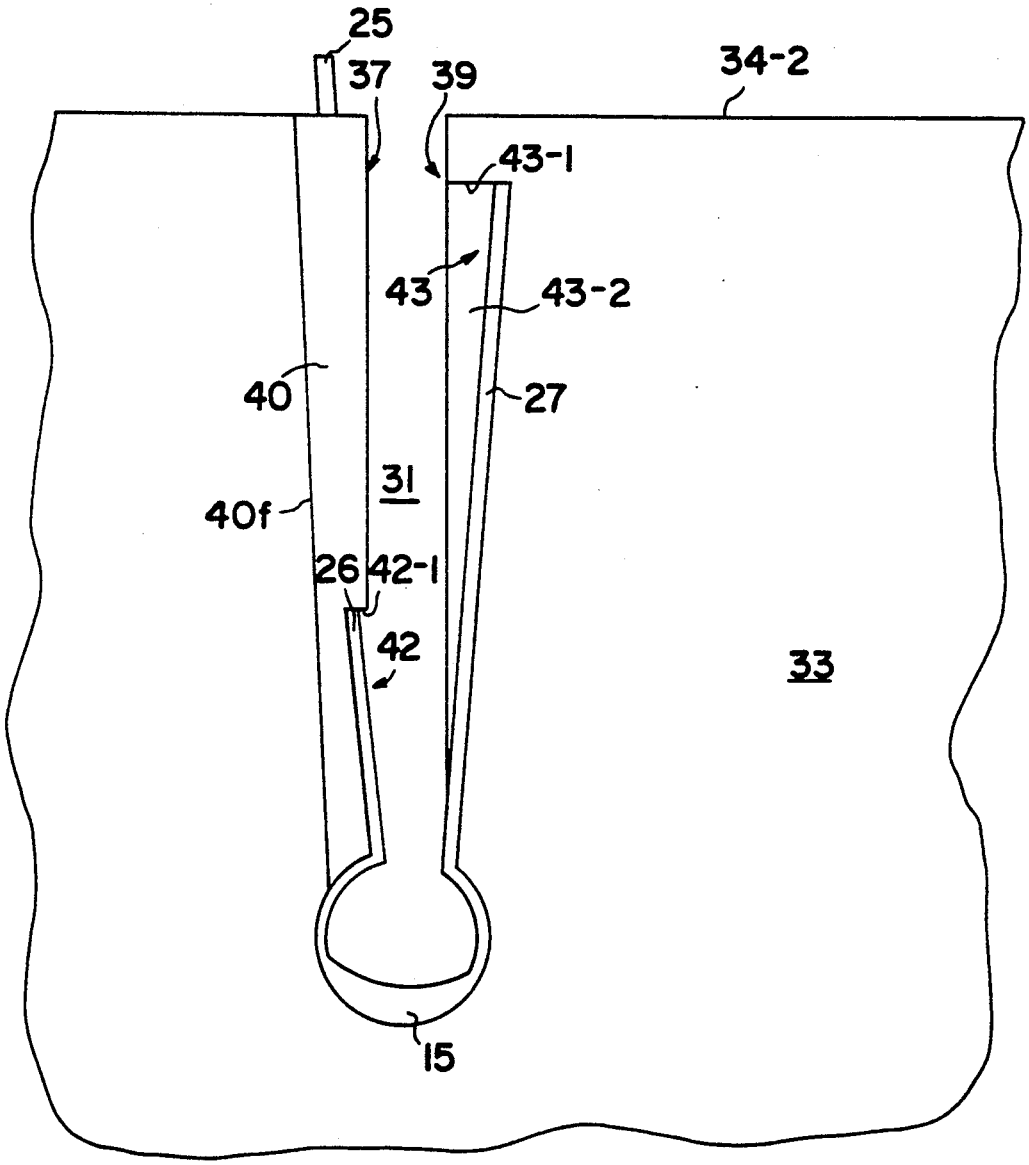
FIG. 8 is a front, fragmentary view showing the needle of FIG. 1 mounted in the opening of FIG. 5, the components of the tool located behind the slot not being shown for purposes of clarity.
Figure 9:
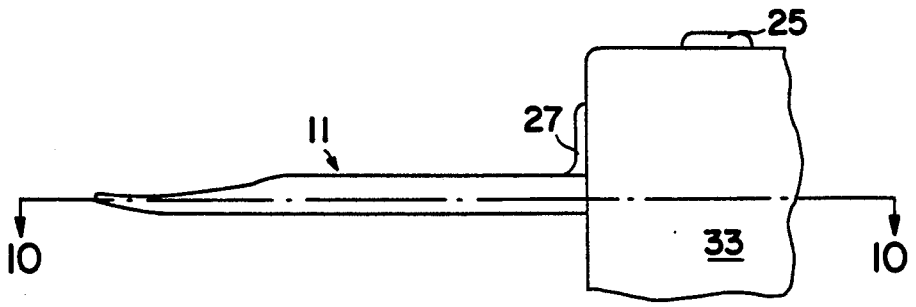
FIG. 9 is a side, fragmentary view showing the needle of FIG. 1 mounted in the opening of FIG. 5.

Referring now to FIGS. 7 through 9, there are shown top, front and side fragmentary views, respectively, needle 11 fully inserted in opening 31. As can be seen in FIG. 9, the top of first portion 25 of tab 24 extends a short distance out of the top of opening 31 to permit it to be manipulated by a user, for instance, in removing needle 11 from the tool. This may be done, as seen in FIG. 7, by pushing first portion 25 towards surface 41, (in the direction of arrow A) until it has cleared surface 41*f* and then pushing (or pulling) base portion through the front of opening 31.

Figure 10:
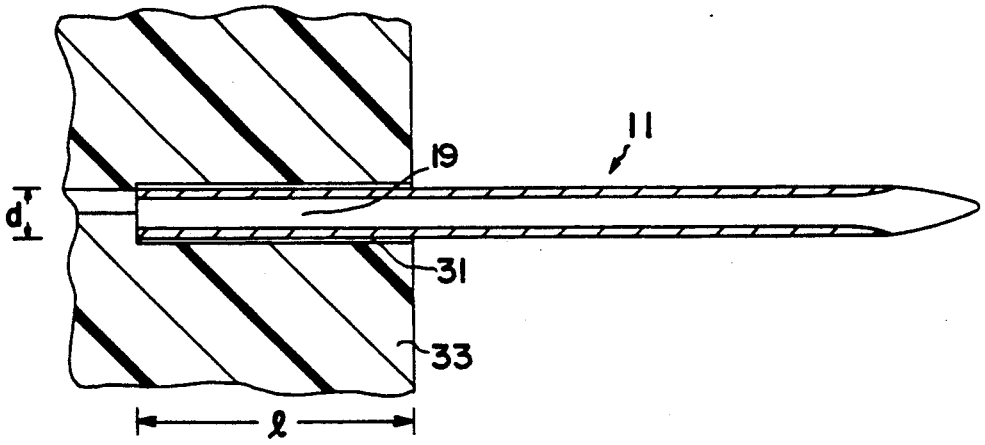
FIG. 10 is a fragmentary section view taken along line A A of FIG. 9.

Referring now to FIG. 10, there is shown a section view of needle 11 mounted in opening 31. As can be seen, that portion of needle 11 that is mounted within opening 31, i.e., base portion 19, has an outer diameter d and a length l. It is believed that the ratio of diameter to length (d/1) is indicative of the relative strength of needle retention as well as the strength and durability of the tool, with smaller ratios indicating greater strength and greater ratios indicating lesser strength. Comparing the d/1 ratio of needle 11 to that for conventional needles of the type described in U.S. Pat. No. 4,273,279, one finds needle 11 to have a smaller d/1 ratio since the lengths of the respective base portions are substantially equal whereas the diameter of the base portion of needle 11 is considerably smaller than the diameter of the base portion of conventional needles. Consequently, it is believed that needle 11 is more fully retained and, therefore, more likely to remain in proper alignment than conventional needles of the type described above.

Figure 11:
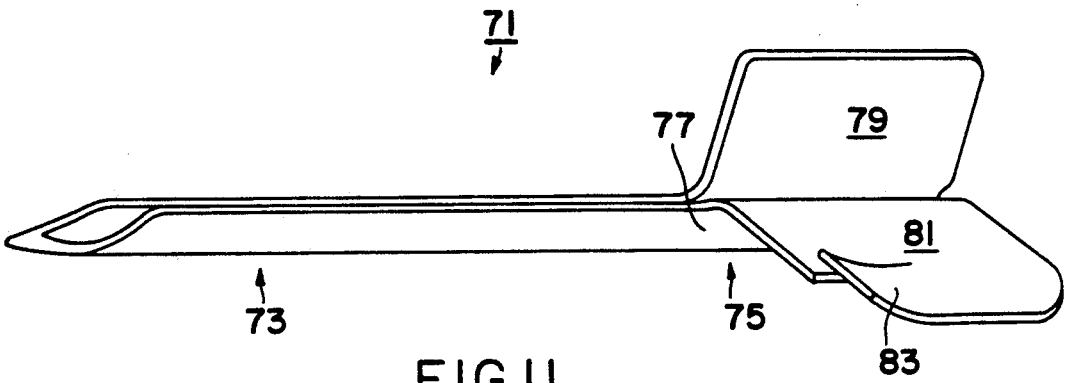
FIG. 11 is a perspective view of a second embodiment of a needle adapted for use as part of a fastener dispensing tool, the needle being constructed according to the teachings of the present invention.

Referring now to FIG. 11, there is shown a second embodiment of a needle for use as part of a fastener dispensing tool, the needle being constructed according to the teachings of the present invention and being represented generally by reference numeral 71.

Figure 12:
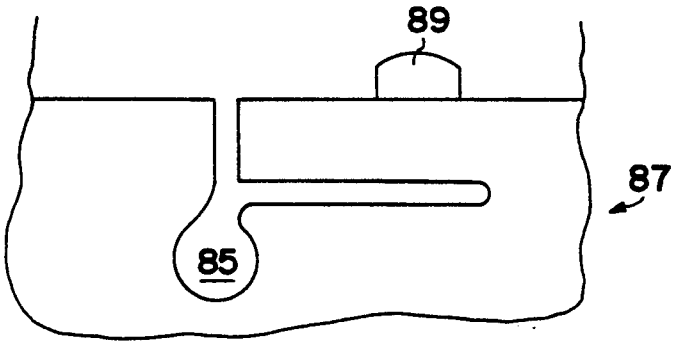
FIG. 12 is a front, fragmentary view of the front end of a fastener dispensing tool illustrating the opening into which the needle of FIG. 11 may be removably mounted.

Needle 71, which, like needle 21, is preferably made by stamping, and/or rolling a sheet of metal, which as a beryllium/copper alloy, comprises a slotted, hollow, cylindrically shaped stem portion 73, which is substantially identical to stem portion 13 of needle 11. Needle 71 also includes a base portion 75, which includes a slotted cylindrically shaped bottom section 77, which has an inner diameter substantially equal to the inner diameter of stem portion 73 and which is aligned therewith. In addition, base portion 75 includes a generally upwardly extending removal tab 79 and a generally laterally extending wing 81. As can be seen, wing 81 is split to include a spring tab 83, which functions to releasably secure base portion 75 within a suitably shaped slot formed in the nose of a fastener dispensing tool. (See, for example, FIG. 12 which illustrates a generally T shaped slot 85 formed in the nose of a fastener dispensing tool 87. Depression of spring tab 83 within slot 85 for purposes of removing needle 71 from tool 87 may be achieved by pushing downwardly on a release button 89 integrally formed on tagger gun 87.)

Figure 13:
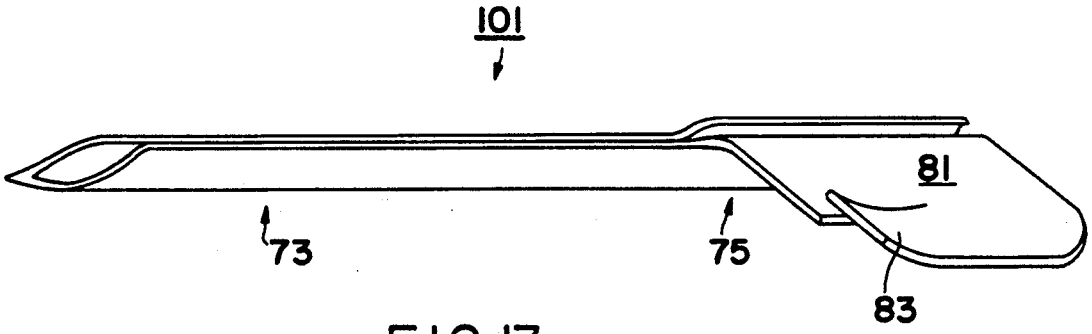
FIG. 13 is a perspective view of a third embodiment of a needle adapted for use as part of a fastener dispensing tool, the needle being constructed according to the teachings of the present invention.

Referring now to FIG. 13, there is shown a third embodiment of a needle for use as part of a fastener dispensing tool, the needle being constructed according to the teachings of the present invention and being represented generally by reference numeral 12.

Needle 101 is substantially identical in construction and composition to needle 71, the only difference between needle 71 and needle 101 being that needle 101 does not include a removal tab 79. Like needle 71, needle 101 may be releasably secured within slot 85 of tool 87 (see FIG. 12).

The embodiments of the present invention described above are intended to be merely exemplary and those skilled in the art shall be able to make numerous variations and modifications to it without departing from the spirit of the present invention. All such variations and modifications are intended to be within the scope of the present invention as defined by the appended claims.

What is claimed is:

1. A needle for use as part of a fastener dispensing tool, the fastener dispensing tool having an opening formed therein to receive the needle, the needle comprising an elongated hollow member having a stem portion and a base portion, said base portion being sized and shaped for insertion into the opening in the fastener dispensing tool, said base portion having a cylindrically shaped bottom section having a longitudinal slot and a first tab constructed for releasably securing said base portion within the opening in the fastener dispensing tool, said first tab being a flexible spring tab movable between a first position relative to said stem during insertion and removal of said needle from said opening, and a second position relative to said stem for retaining said needle within said opening said stem portion being cylindrically shaped and including a longitudinal slot aligned with said longitudinal slot in base portion.

2. The needle as claimed in claim 1 wherein said first tab is sized so that when said needle is inserted into said opening of said fastener dispensing tool at least a portion of said first tab extends partially out of said opening so that said first tab can be manipulated by a finger of a person.

3. The needle as claimed in claim 1 wherein said first tab includes a portion for keeping said base portion from moving upwardly when said needle is seated within said opening.

4. The needle as claimed in claim 1 wherein said elongated, hollow member also includes means for aligning the needle when seated in said opening in said fastener dispensing tool.

5. The needle as claimed in claim 4 wherein said aligning means comprises a second tab formed on said base portion said second tab also being a spring tab.

6. The needle as claimed in claim 5 wherein said first tab and said second tab extend outwardly in substantially different directions.

7. The needle as claimed in claim 6 wherein said first and second tabs are at about right angles to each other.

8. The needle as claimed in claim 5 wherein said first tab and said second tab extend generally upwardly and outwardly away from each other.

9. The needle as claimed in claim 1 wherein said stem portion and said base portion are formed from a single piece of material.

10. The needle as claimed in claim 9 wherein said stem portion and said base portion are stamped from a single sheet of metal.

11. The needle as claimed in claim 10 wherein said single sheet of metal is selected from the group consisting of stainless steel, steel and coated steel.

12. The needle as claimed in claim 10 wherein said single sheet of metal is a beryllium/copper alloy.

13. The needle as claimed in claim 9 wherein said stem portion and said base portion are rolled from a single sheet of metal.

14. The needle as claimed in claim 1 wherein said needle includes a laterally extending wing split to define a first portion and a second portion and said spring tab is said first portion.

* * * * *